US005181450A

United States Patent [19]

Monacelli

[11] Patent Number: 5,181,450

[45] Date of Patent: Jan. 26, 1993

[54] PNEUMATIC FASTENER DRIVING APPARATUS WITH PISTON HOLDING DETENT

[76] Inventor: Umberto Monacelli, via Parini, 6, I-20052 Monza, Italy

[21] Appl. No.: 701,174

[22] Filed: May 16, 1991

[51] Int. Cl.[5] ..... F15B 15/26; B25C 1/00

[52] U.S. Cl. ..... 91/41; 91/417 A; 91/461; 173/127; 227/130

[58] Field of Search ..... 91/417 A, 461, 442, 91/41, 43, 44; 92/15, 19; 173/126, 127; 227/130

[56] References Cited

U.S. PATENT DOCUMENTS

| | | | |
|---|---|---|---|
| 2,899,935 | 8/1959 | Dalton | 91/44 X |
| 2,959,155 | 11/1960 | Powers | 227/130 X |
| 2,983,922 | 5/1961 | Juilfs | 91/461 X |
| 3,397,617 | 8/1968 | Cast et al. | 91/41 |
| 3,638,534 | 2/1972 | Ramspeck | 91/461 X |
| 3,969,988 | 7/1976 | Mauer | 227/130 X |
| 4,173,171 | 11/1979 | Lange | 91/417 A X |
| 4,747,338 | 5/1988 | Crutcher | 91/461 |

FOREIGN PATENT DOCUMENTS 1424792 2/1976 United Kingdom .

*Primary Examiner*—Edward K. Look
*Assistant Examiner*—John Ryznic
*Attorney, Agent, or Firm*—Welsh & Katz, Ltd.

[57] ABSTRACT

A pneumatic operated fastener driving device having an improved piston, which together with the cylinder form an elastic interference fit connection so that the piston is held from movement until a sufficient air pressure is applied to the piston. The piston has little or no frictional resistance with the inner surface of the cylinder during the driving or return stroke.

6 Claims, 4 Drawing Sheets

PNEUMATIC FASTENER DRIVING APPARATUS WITH PISTON HOLDING DETENT

BACKGROUND OF THE INVENTION

1. Field of the Invention

This invention relates to a pneumatic fastener driving tool, and more particularly to an improved piston for use in such a tool.

2. Background of the Invention

Pneumatic tools for driving fasteners such as nails, staples, brads and the like are commonly used in the commercial work place. All of these devices have standard components comprising a housing to store compressed air, a cylinder in which a piston and driver combination are driven in a reciprocating manner, a valve means to provide pressurized air to the piston and a fastener carrier means to position the fastener underneath the driver prior to the driving stroke.

Most tools are operated by positioning the tool in contact with the workpiece and manually pulling a trigger which in turn operates a valve means that provides compressed air to the top side of the piston. When the tool is used as a stationary device the trigger is replaced by a remote actuator.

As the piston reaches the end of the driving stroke, a return air chamber is pressurized to provide air for the return stroke of the piston and driver. After the trigger is released, the valve closes blocking air into the top of the cylinder and in turn opens an exhaust port to release the air above the piston to the atmosphere. The stored air within the return chamber acts upon the underside of the piston to return in to the rest position at the uppermost portion of the cylinder.

To provide enough power to drive the fastener, the air must enter the cylinder above the piston quickly. To accomplish this, the valve means is normally divided into two functions. A firing valve is located directly above the top of the cylinder and is shifted from a closed position pneumatically by a trigger valve. By utilizing air pressure, the firing valve can be held closed tightly and then opened with a snap action when air pressure on a portion of the valve is reduced.

Although the firing valve is designed to open quickly, the air starts to enter the area above the piston as soon as the valve begins its initial movement. This causes the piston to begin its movement at a pressure much less than that within the compressed air chamber of the housing due to air flow restriction between the cylinder and the firing valve. The piston does not achieve the desired velocity until a portion of the total drive stroke is used, and thus, does not develop maximum power.

In order to delay the start of the piston until the valve opens further and the pressure on the top of the piston builds up, it is desirable to hold the piston momentarily in its uppermost position. This feature has been achieved as disclosed in U.S. Pat. No. 3,397,617. Although the described means accomplishes the delay action, it introduces an undesirable condition in that air is lost between the outside of the piston and the inner cylinder wall.

Many applications using portable fastener driving tools have a limited air source. Any air not used during the driving cycle is costly and restricts the amount of fasteners that can be driven before the air source can be replenish with the air that is lost. The loss of air between the piston and the cylinder can be eliminated by the addition of a seal mounted on the piston and having an air sealing surface in contact with the inner wall of the cylinder.

The most commonly used seal is an O-ring, which would stop the loss of air by placing the O-ring in frictional contact with the inner wall of the cylinder. However, the O-ring sliding against the cylinder wall could cause an even more serious problem. Specifically, the air sources normally used for these type of pneumatically operated tools are subject to dirt and other contaminates that shorten the life of such seals. Also, the lack of proper lubrication causes excessive wear on seals and usually results in the tool losing power with use, or failing to function altogether. Frictional movement of pneumatic seals is the cause for most service calls for these tools.

SUMMARY OF THE INVENTION

The present invention has taken into account these and other disadvantages and therefor it is a primary object of the present invention to provide an improved pneumatic fastener driving apparatus with an improved piston, which provides a better drive and is subject to less failure.

Another object is to provide an improved pneumatic fastener driving apparatus having an improved piston and cylinder that does not allow air loss when in the rest position and provides frictionless movement during the driving stroke.

A further object of the present invention is to provide an improved pneumatic driving apparatus including a housing including a compressed air chamber; a cylinder disposed within the housing and fluidly connected to the compressed air chamber; a piston slidably disposed within the cylinder for undergoing reciprocating movement between a first home position and a second remote position, the piston and the cylinder having portions providing an elastic interference fit connection therebetween tending to retain the piston in its first home position; a fastner driving element connected to the piston; and means for controlling the flow of compressed air from the air chamber to the cylinder and the piston, wherein the interference fit connection is continued after until sufficient air pressure is provided on the piston to disengage the connection between the piston and the cylinder and causing thereafter the piston and fastner driving element to be driven towards the second remote position.

DETAILED DESCRIPTION OF PREFERRED EMBODIMENTS

Figure 1:
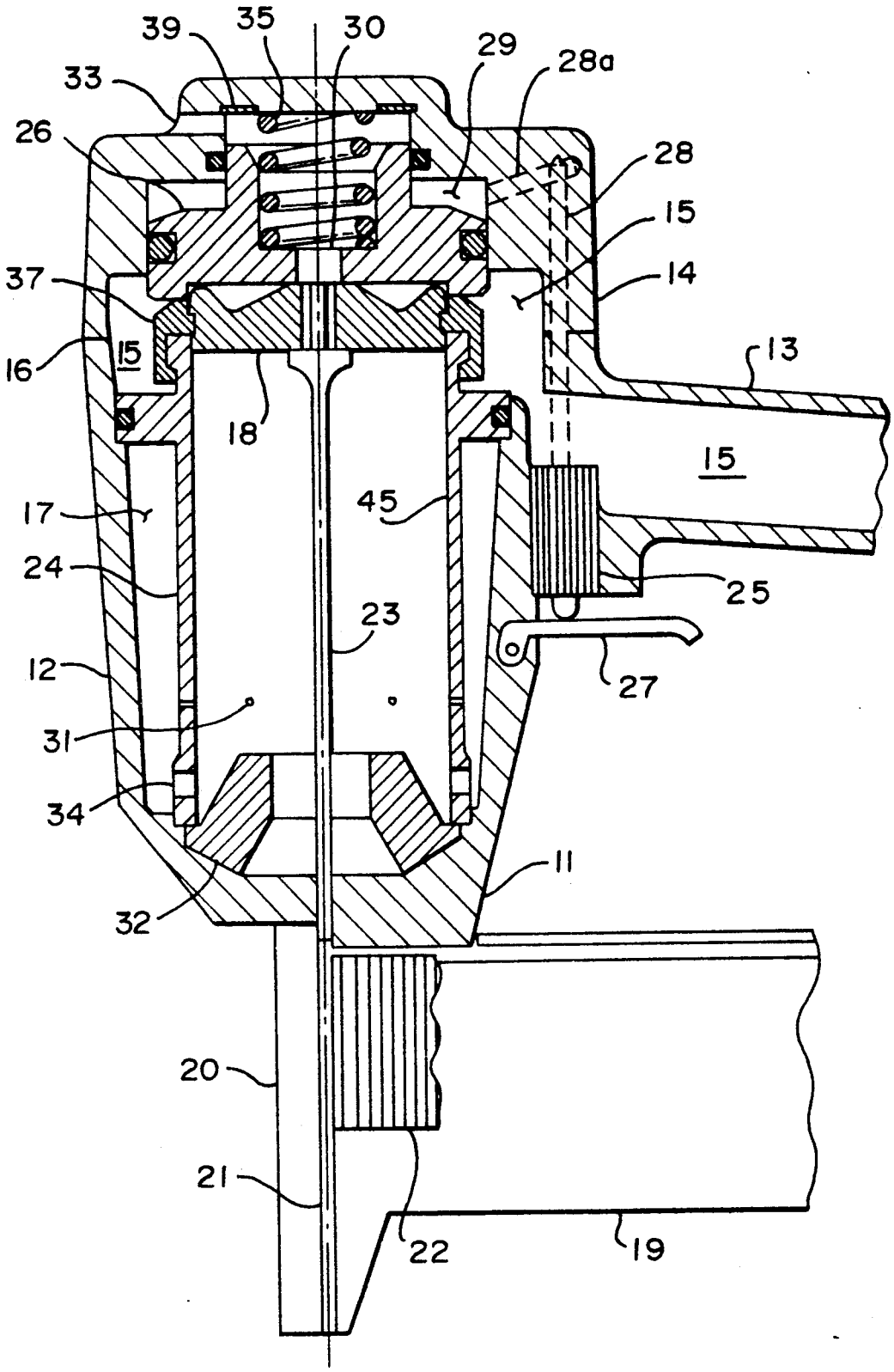
FIG. 1 is a partial cross-sectional view of a pneumatic fastener driving tool according to the present invention.

Referring to FIG. 1, the tool includes a housing 11 comprising a body portion 12, a handle 13 and a cap 14. The size and shape vary considerably depending on the type of fastener and application, but all have in common an internal opening used as an air pressure reservoir or chamber 15. The air chamber 15 is pressurized from an air line source by an inlet connection attached to the handle (not shown).

In the embodiment shown in FIG. 1, the cap 14 is attached to the body 12 with screws (not shown) and utilizes part of the cap 14 to enlarge the air chamber 15. The body 12 and cap 14 are joined by a seal 16 to prevent compressed air escaping to the atmosphere. An opening within the body 12 is divided into two sections including the compressed air chamber 15 and a return air chamber 17. The return air chamber 17 is pressurized when the piston 18 is near the end of the drive stroke. The sequence of pressurizing the return chamber 17 will be described in detail below.

The lower portion of the housing 11 is provide with a fastener carrying rail 19. The front of the rail 19 is defined by a nose piece 20 and includes a guiding cavity shaped to match that of the fastener 22. A pusher means (not shown) delivers the fastener 22 into the nose cavity 21 underneath the end of the driver 23, which is fixed to the piston 18 and function together as a unit.

A cylinder 24 is mounted in the housing 11 as a unit with the piston 18 slidably disposed therein for reciprocating movement. To control the movement of the piston 18, a valve means is employed comprising a trigger valve 25 positioned near the handle 13 and a main valve 26, located above the cylinder 24.

The trigger valve 25 is controlled by a manual lever 27, as shown in FIG. 1. Actuation of the lever 27 causes the trigger valve 25 to exhaust passageways 28, 28*a* to shift the main valve 26, when pulled and pressurizes the passageways when lever 27 is released. In FIG. 1, the tool is manually operated, however, if tool is part of a stationary application the trigger valve means could be a remotely located valve and operated by something other than lever 27.

A sequential function of an embodiment of the fastener driving apparatus according to the present invention will be described as follows. When an air supply is connected to the tool, the air chamber 15, passageway 28, 28*a*, and cavity 29 are pressurized. The piston return chamber 17, passageways 30 and the volume located below the piston 18 in the cylinder 24 remain unpressurized. A fastener 22 is positioned in the nose piece 20 underneath the driver 23 from a previous tool cycle.

Figure 3:
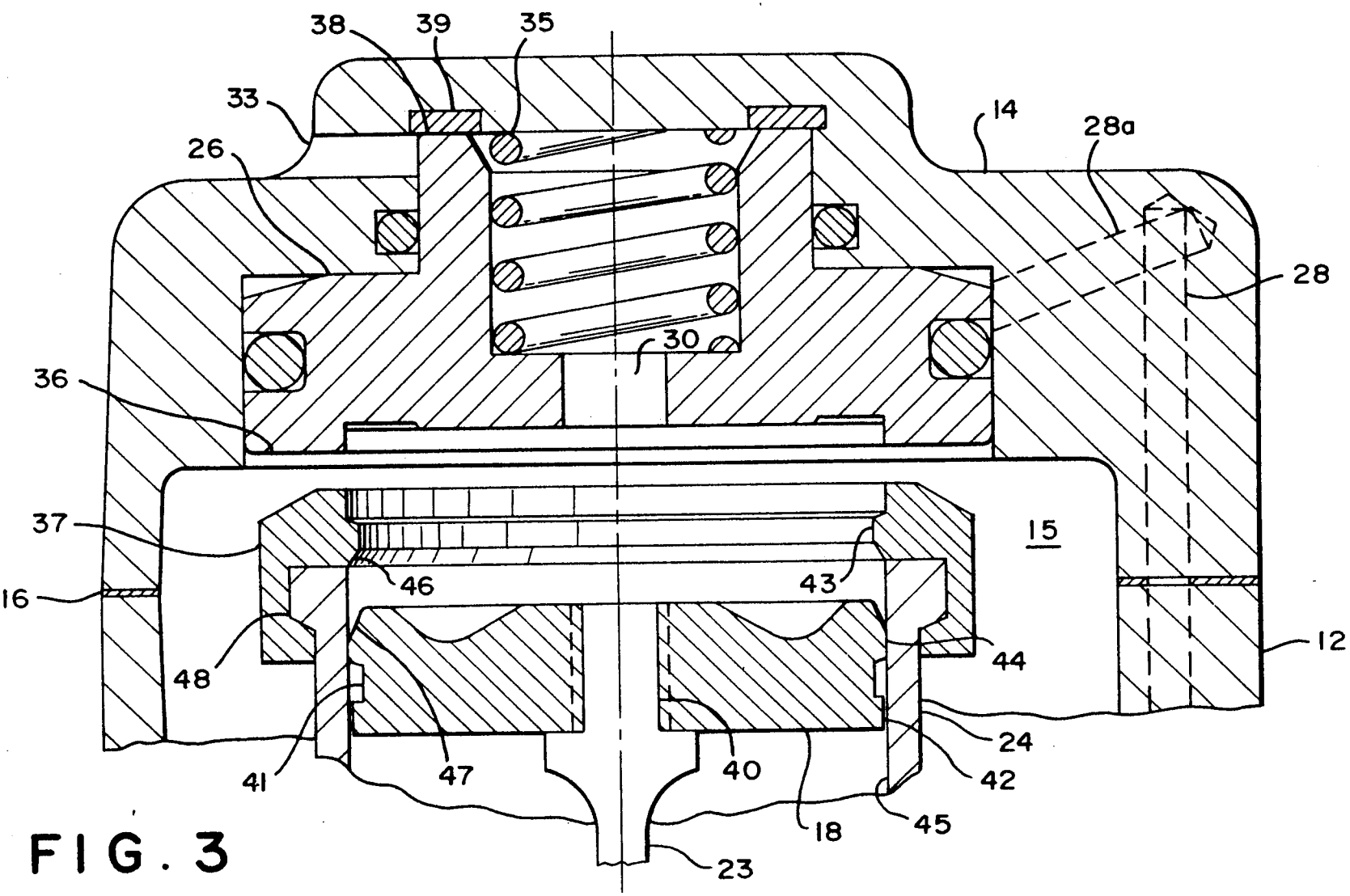
FIG. 3 is an enlarged scale view of the upper portion of the tool showing the piston disengaged and starting a downward drive stroke.

The tool is positioned on the workpiece and the trigger lever 27 is pulled upwardly. The trigger valve 25 actuates to exhaust air passageways 28, 28*a* and cavity 29. The main valve 26, which was previously closed, now shifts to an open position, as shown in FIG. 3, due to the pressurized air in the air chamber 15 acting upon the bottom area of the valve.

The shifting of the valve 26 allows air to enter the top of the cylinder 24 above the piston 18 while at the same time blocking communication to the atmosphere through passageway 30. The piston 18 along with driver 23 is forced down rapidly. The driver 23 then pushes the fastener 22 into the workpiece (not shown).

Near the end of the drive stroke, the piston 18 passes a series of small holes 31 in the cylinder 24 that allows air to enter and pressurize the return chamber 17. At the end of the drive stroke, the underside of the piston 18 contacts a shock absorber 32 The shock absorber 32 prevents damage to the tool that may occur should the piston 18 strike the housing 11 directly. The shock absorber 32 also acts as a seal to prevent air from the return chamber to escape into the atmosphere.

The lever 27 is then released and trigger valve 25 repressurizes passageways 28, 28*a* and cavity 29. The valve 26 is forced toward cylinder 24 by spring 35 whenever both the upper side and lower side of the valve 26 are subjected to equal air pressure. The valve 26, thus closes when cavity 29 is pressurized, by trigger valve 25, and communication between reservoir 15 and the top of the cylinder 24 is blocked.

The shifting of the valve 26 to the closed position allows the space above the piston 18 to again communicate with the atmosphere and the air above the piston 18 exhausts through passageway 30 and exhaust port 33. When the air pressure above the piston 18 drops below that under the piston 18, the air in the return chamber 17 enters the cylinder 24 under the piston 18 through holes 34 and forces the piston 18 and driver 21 upwardly. Chamber 17 has a fixed volume, thus as the piston 18 moves upwardly, the pressure in chamber 17 is reduced. The chamber 17 is designed to provide enough air to fully return the piston 18 at the lowest operating pressure with the pressure nearly reduced to that of the atmosphere prior to the next tool cycle. As the end of the driver 23 raises above the fastener rail 19, the next fastener 22 is positioned into the nose piece cavity 21 ready to be driven during the next tool cycle.

There are numerous valve configurations now in use on fastener driving tools, which vary from quite complicated to simpler designs, such as the one illustrated. Alternative means for shifting the valves, returning the piston, stopping the stroke, feeding fasteners into position can be substitute for these related components of the embodiment illustrated and described. Further, although the cycle sequence described may be preferred for a particular tool, it in no way restricts or limits the present invention other than that defined in the claims.

Figure 2:
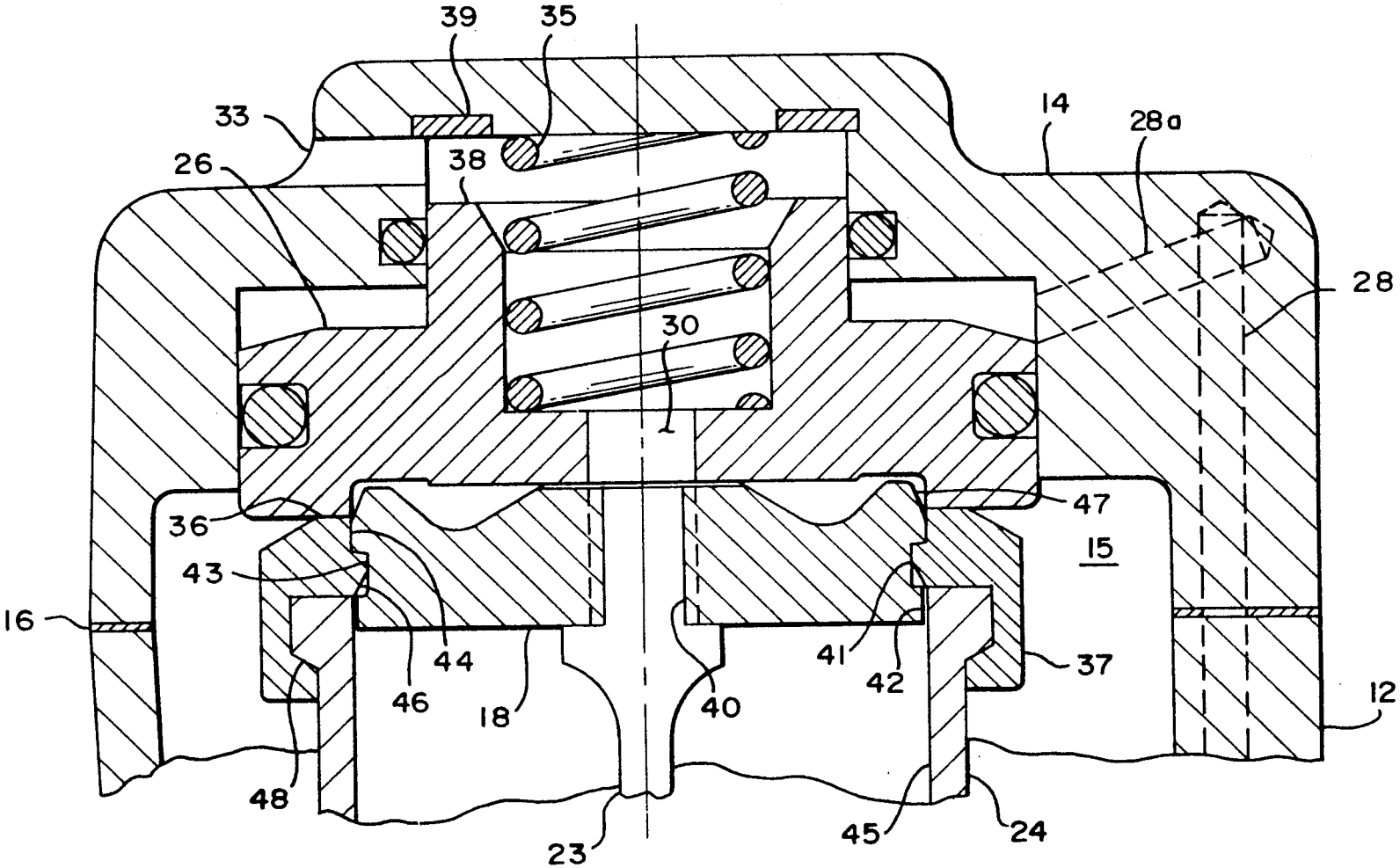
FIG. 2 is an enlarged scale view of the upper portion of the tool showing the piston engaged with the uppermost portion of the cylinder.

Referring to FIG. 2, the valve 26 is shown as being closed with the piston 18 positioned in the uppermost position within the cylinder 24. The lower portion 36 of valve 26 is in contact with a ring 37 or detent, which is made from an elastic material and acts as a seal. The ring 37 is securely held onto the cylinder 24 by a mating fit 48. The valve 26 is forced tightly against ring 37, thus preventing air within reservoir 15 from entering the area above piston 18. The top portion 38 of valve 36 is away from seal 39, thus the area above piston 18 is in communication with the atmosphere through passageway 30 and exhaust port 33. This condition is referred to as the valve 26 in the closed position.

Referring to FIG. 3, the valve 26 has been shifted upwardly to break contact with ring 37 and seats against seal 39. Air can now enter the area above piston 18, but is blocked from the atmosphere. This condition is referred to as the valve 26 is the open position.

The piston 18 includes the driver 23 attached to the underside thereof, and when assembled acts as a single unit. The attachment illustrated is that of the piston 18 and driver 23 having matching internal and external threads 40. Depending on the type of tool, the attachment can also be made using screws, nuts, pins and the like. The attachment may also be a loose fit as well as rigid.

Referring again to FIG. 2, the piston 18 has a circumferential recess 41 on the periphery 42, and the ring 37 has an inwardly extending protrusion 43 having a diameter somewhat less than the inside diameter of the cylinder 24 and the outside diameter of the piston 18. When the piston 18 is in its uppermost or home position, the protrusion 43 extends into the recess 41 acting as a detente to retain the piston in its home position shown in FIGS. 1 and 2. The piston 18 remains engaged with the ring 37 until a force other than gravity is applied to the top of the piston 18.

At the start of the driving cycle, the lever 27 is pulled, trigger valve 25 exhausts passageways 28, 28*a* and cavity 29, and valve 26 starts moving upwardly. As the bottom 36 of valve 26 moves, the air tight seal is broken and air from reservoir 15 starts to enter the area above the piston 18. The downward force on piston 18 keeps the top side 44 of recess 41 in contact with protrusion 43. The ring 37 is made from an elastic material, thus the piston 18 and ring 37 block any air from flowing past the periphery 42 of the piston 18.

The valve 26 continues to move upwardly until it is in the open position, as shown in FIG. 3. The air pressure on top of piston 18 creates a force larger than the interference engagement between piston 18 and ring 37. The protrusion 43 expands outwardly as the force on the piston 18 increases until the inside diameter is equal to the outside diameter of the piston 18 at which time the piston 18 becomes disengaged with ring 37 and is free to begin the drive stroke.

The piston 18 having an outside diameter less than the inside diameter of cylinder 24 and having no seal attached thereto will move the full drive and return stroke without any frictional contact with the cylinder 24. It should be understood that the intent of the phrase "without any frictional contact", is distinguished from occasional touching due to small clearances between components, to that of constant sliding contact of a seal, such as an O-ring against an inside wall 45 of the cylinder 24.

The piston 18 and cylinder 24 can be sized to assure that the piston 18 never touches cylinder wall 45, but the clearance would have to be large since the only means of guidance of the piston would be accomplished by the fit between the drive 23 and housing 11. A large clearance between the piston 18 and cylinder wall 45 would allow air to escape, and thus decrease the efficiency of the tool. With this in mind, the clearance between the piston 18 and cylinder wall 45 is preferably 0.1 to 0.2 millimeters, rather than something over 0.5 millimeters. This will greatly reduce the loss of air and yet provide a frictionless movement even though the piston 18 may at times touch the cylinder wall 45.

Upon the return stroke, the piston 18 must force the protrusion 43 to expand enough to allow the top side 44 to pass thereby. Although the disengagement needs to have a resistance, the engagement on the return stroke should be made easy to accomplish since the air pressure used for the return of the piston 18 is greatly reduced by the time the piston 18 has reach the ring 37. The preferred way is to provide a chamfer 46 on the lower side of the protrusion 43 and a chamfer 47 on the outside diameter of the piston 18. As the two chamfers 46,47 make contact, the protrusion 43 is forced outwardly until the recess 41 again aligns with the protrusion 43.

Figure 4:
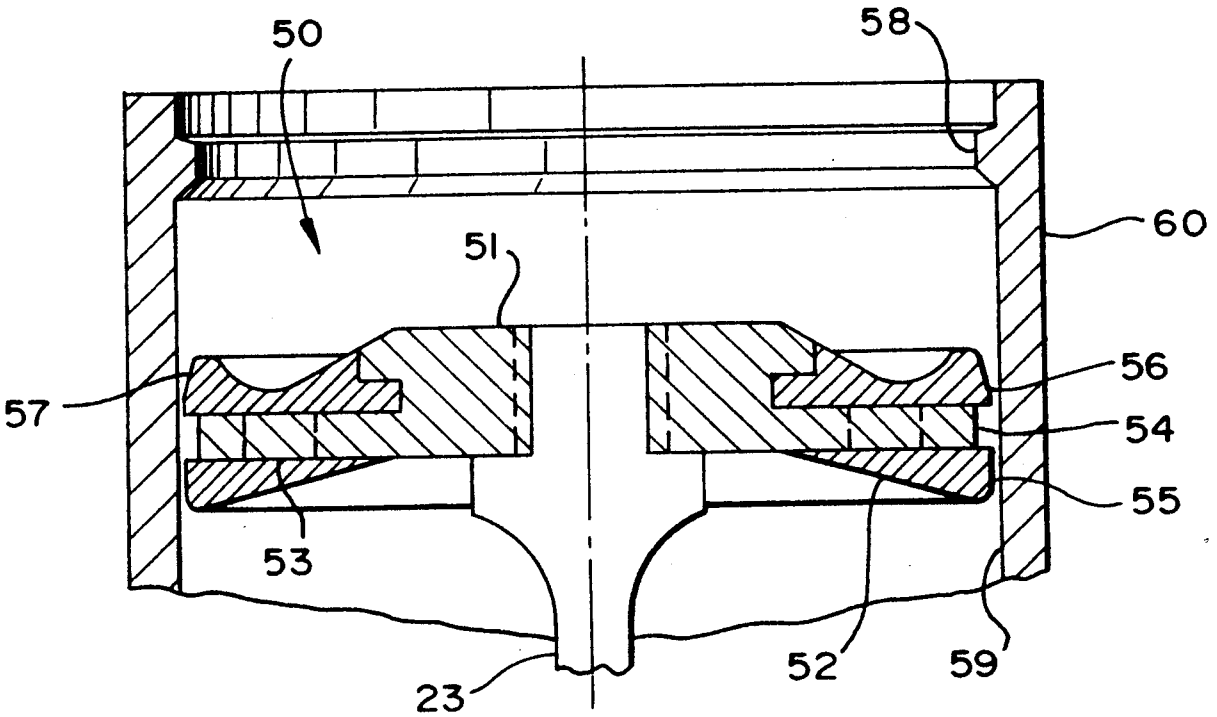
FIG. 4 is a partial cross-sectional view of another embodiment of the pneumatic fastener driving tool according to the present invention.

Although the present invention is illustrated in FIGS. 2 and 3 in the preferred embodiment, an alternative embodiment is illustrated in FIG. 4. In this embodiment, a piston 50 is constructed of more than one material. The center portion 51 is rigid and attached to driver 23 in a like manner previously described. The outer portion 52 is an elastic molded material bonded to the center portion 51. There are several holes 53 in the center portion 51 to allow the molded material 52 to form a secure attachment. The circumferential recess 54, periphery 55, top portion 56 and chamfer 57 correspond to the like features shown as components 41, 42, 44 and 47 in the previous description of piston 18.

The top of cylinder 60 includes a portion 58 that extends inwardly more than surface 59, which defines the inside diameter of the cylinder 60. It is also conceived that portion 58 could be part of an attachable piece similar to that of ring 37 or a circular strip inserted into the cylinder 60.

The cycle and movement of components are the same as previously described except in this embodiment the top portion 57 of piston 50 is squeezed inwardly to pass rigid portion 58, rather than the protrusion 43 expanding outwardly. A combination of the two embodiments could also function by having piston 50 used with ring 37 thereby both components have an elastic interface.

It must be understood that the terms upper, lower, above, downward and the like are used in reference to the illustrations shown in FIGS. 1, 2 and 3 solely for the purpose of clarity.

While preferred embodiment of the present invention have been illustrated and described, it is anticipated those skilled in the art may make numerous changes and modifications without departing from the spirit of this invention, which is intended to be limited only by the scope of the following appended claims.

I claim:

1. A pneumatic powered fastener driving apparatus, comprising:

a) a compressed air chamber;

b) a housing for receiving a cylinder having a first inner diameter;

c) a detent affixed to said cylinder and providing an inwardly extending circumferential engaging surface, said inwardly extending circumferential surface having a second inner diameter less than said first inner diameter;

d) a circumferential seal;

e) a piston slidably disposed within said cylinder for reciprocating movement between a first home position and a second remote position, said piston having an outer circumferential surface adapted to engage said inwardly extending circumferential surface of said detent, said outer circumferential surface having a third diameter selected to be sufficiently less than said second inner diameter so that said detent forms a first air tight seal between said cylinder and said piston and to maintain of itself said piston in its first home position;

f) a first valve moveable within said housing between a third home position, wherein said circumferential seal, said cylinder and said first valve forms a second air tight seal therebetween, said first and second air tight seals establishing a pocket comprised of said cylinder, said piston and said first moveable valve when said piston is disposed in its first home position and said first moveable valve is disposed in its third home position, and a fourth open position for permitting the flow of compressed air from said chamber to said pocket; and g) a second valve actuatable for moving said first valve from its third home position towards its fourth open position, whereby the compressed air enters said pocket increasing the pressure of the air therein to a level sufficient to disengage said detent from said piston and thereafter, rapidly moving said piston from its first home position toward its second remote position.

2. An apparatus according to claim 1, wherein said detent is made of an elastic material and said piston includes an outwardly extending portion and a circumferential recess positioned adjacent said outwardly extending portion, said detent and said outwardly extending portion of said piston being elastically interference fitted together, and wherein said detent is more flexible than said outwardly extending portion of said piston.

3. An apparatus according to claim 1, wherein said piston is provided with a recess and an outwardly extending portion forms an elastic interference fit with said inwardly extending circumferential surface of said detent, and said outwardly extending portion of said piston is more flexible than said detent.

4. An apparatus according to claim 3, wherein said piston comprises more than one type of material with said outwardly extending portion of said piston being made of elastic material.

5. An apparatus according to claim 2, wherein said piston is constructed so as to have substantially no frictional engagement with said cylinder after disengagement of said detent and said recess.

6. An apparatus according to claim 4, wherein said piston is constructed so as to have substantially no frictional engagement with said cylinder after disengagement of said detent and said recess.

* * * * *